US006412718B1

(12) United States Patent
Köhl et al.

(10) Patent No.: US 6,412,718 B1
(45) Date of Patent: Jul. 2, 2002

(54) ROTOR FOR A REDUCING MACHINE

(75) Inventors: Erich Köhl, Meerbusch; Martin Hassler, Düsseldorf, both of (DE)

(73) Assignee: Svedala Lindemann GmbH, Düsseldorf (DE)

( * ) Notice: Subject to any disclaimer, the term of this patent is extended or adjusted under 35 U.S.C. 154(b) by 0 days.

(21) Appl. No.: 09/581,613

(22) PCT Filed: Dec. 1, 1998

(86) PCT No.: PCT/DE98/03529

§ 371 (c)(1),
(2), (4) Date: Jul. 11, 2000

(87) PCT Pub. No.: WO99/32228

PCT Pub. Date: Jul. 1, 1999

(30) Foreign Application Priority Data

Dec. 18, 1997 (DE) ..... 197 56 275

(51) Int. Cl.[7] ..... B02C 13/04
(52) U.S. Cl. ..... 241/194; 241/197; 241/300
(58) Field of Search ..... 241/194, 197, 241/300

(56) References Cited

U.S. PATENT DOCUMENTS 4,222,530 A * 9/1980 Whitney ..... 241/197
4,313,575 A * 2/1982 Stepanek ..... 241/197
5,188,303 A * 2/1993 Hoof ..... 241/197

FOREIGN PATENT DOCUMENTS

DE 4343801 A1 * 6/1995
EP 0368759 A2 * 5/1990
FR 2598099 * 11/1987
JP 06059995 * 9/1995

* cited by examiner

*Primary Examiner*—Mark Rosenbaum
(74) *Attorney, Agent, or Firm*—Norris McLaughlin & Marcus

(57) ABSTRACT

The invention relates to a rotor (1) for a reducing machine. According to the invention, the protective caps (6.1) covering the outer plates (3.1) of the rotor (1) are decoupled from the forces of the hammer axles (5) and from the forces exerted directly on the outer protective caps (6.1) by the hammers. The outer protective caps (6.1) which are exposed to the lateral forces of the hammers (4) encompass the outer edge of each of the plates (3.1) with a web (6.2) and encompass each of the inner steps (3.2) of the plate (3.1) with a projection (6.5) in the shape of a ring segment. At the same time, these outer protective caps (3.1) are mounted on the plate (3.1) with a positive fit by means of a connecting element (9) such as a hexagon socket screw. The outer protective caps (3.1) which are adjacent to the inner protective caps (6) are fixed to the outer plate (3.1) with a non-positive fit, also by means of connecting elements (9) such as hexagon socket screws (3.1). A locking dog (8) which is also fixed directly to the plate (3.1) secures and limits the axial position of the respective hammer axle (5) in the plate (3.1).

9 Claims, 2 Drawing Sheets

Fig. 2
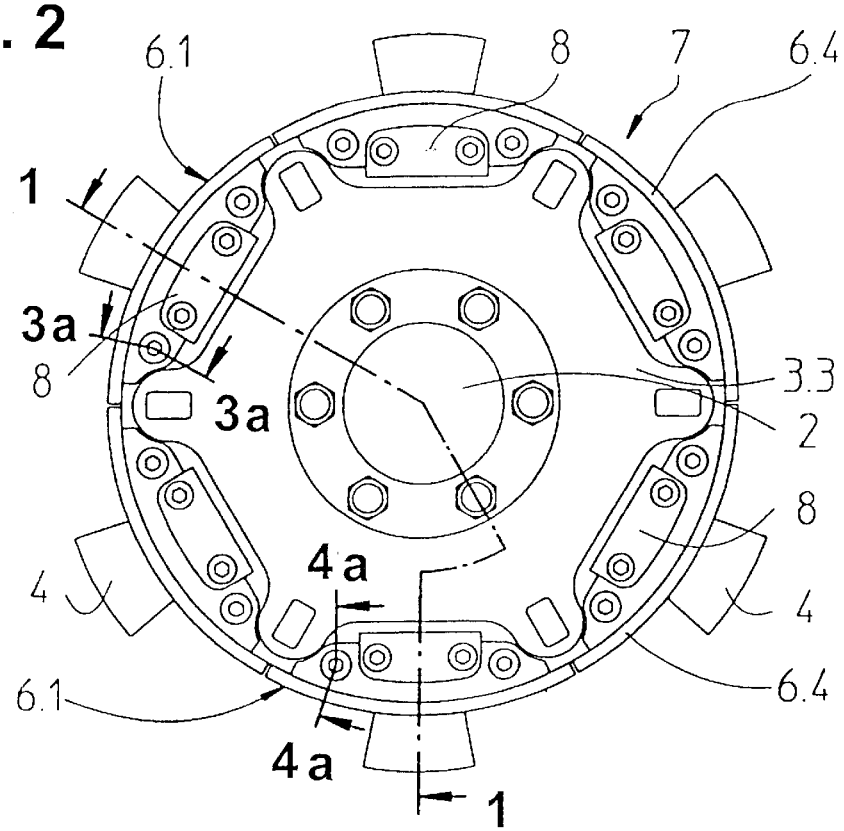
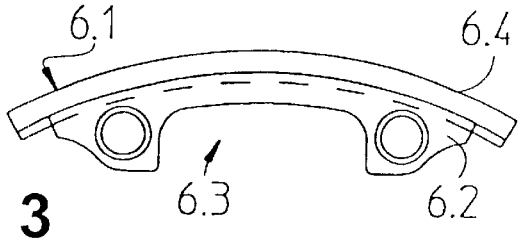
Fig. 3
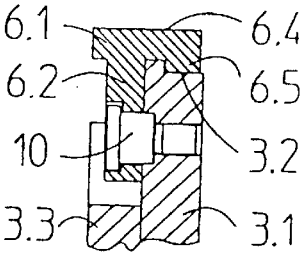
Fig. 3a
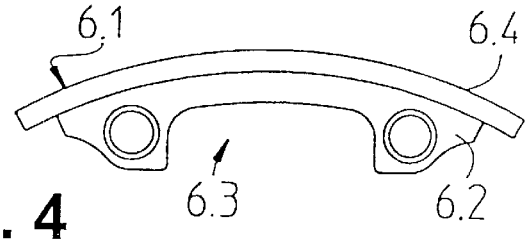
Fig. 4
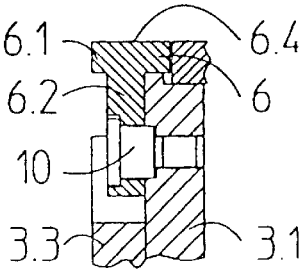
Fig. 4a
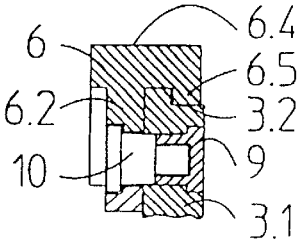
Fig. 5

ROTOR FOR A REDUCING MACHINE

BACKGROUND OF THE INVENTION

1. Field of the Invention

The invention relates to a rotor for a comminution machine according to the preamble of claim 1, which includes several disks which are non-rotatably secured on a shaft, rotatable hammers distributed between the disks, and protective caps covering the rotor to protect against wear.

2. Description of the Related Art

Rotors of this type are known from DE 26 05 751 A1, with modifications disclosed in DE 43 43 801 A1 so as to form a wear part system. A closer examination of the role played by protective caps covering the rotor against wear reveals that the outer protective caps, which cover the outer disks of the rotor, are of particular importance in the rotor system, both as a tool as well as to protect the comminution machine system. Although the outer protective caps, like the other protective caps, can be categorized initially as inactive wear parts, they have to perform additional functions due to the particular forces they are subjected to. Until now, the outer protective caps were secured rather loosely above the hammer axis against the effect produced by centrifugal forces and by external forces pointing in the radial direction. A prior art element, a so-called locking dog, which is secured on the outer disks, fixes the position of the hammer axis and, at the same time, covers the web of the protective cap which projects over the disk. Although in practical applications, this constructive solution withstood the rigors of the comminution process, the forces and the torque exerted by the hammer and the hammer axis on the closing element and the cap created problems which can in the end lead to extensive damage.

GB 2 143 748 A2 discloses a rotor for a comminution machine with several disks which are non-rotatably secured to a shaft, and hammers distributed between the disks, wherein the hammers are rotatably supported on hammer axes which extend through the disks and are parallel and eccentric with respect to the shaft. At least the protective caps which cover the components of the rotor exposed to secondary wear, have elements formed as segments of a circular arc, with the bearing hub of the protective caps attached between the disks on the hammer axes. The rotor with the protective caps, wherein the elements of the protective caps are in the form of a segment of a circular arc, forms a substantially cylindrical jacket with openings which are mutually offset in a predetermined fashion so that the hammers can swing through and the outer protective caps are decoupled from the forces of the hammers and the hammer axes. A locking dog which is directly attached to the end disks, limits and secures the actual position of the respective hammer axis on the end disk.

In addition, U.S. Pat. No. 4,222,530 discloses that the protective caps covering the outer disks of the rotor are decoupled from the forces of the hammers and the hammer axes and from the forces exerted directly by the hammers on the outer protective caps, wherein the protective caps encompass the disk and are secured on the disk for force transmission by at least one connecting element.

In spite of the decoupling of the forces, as described above, the construction of the aforedescribed rotors is complex and therefore expensive.

SUMMARY OF THE INVENTION

It is a object of the invention to provide a rotor for a comminution machine with several disks which are non-rotatably secured on a shaft, and with hammers distributed between the disks, wherein the hammers are rotatably supported on hammer axes which extend through the disks and are parallel and eccentric with respect to the shaft. At least the parts of the rotor subjected to the secondary wear include protective caps having elements formed as segments of a circular arc, wherein the bearing hubs of the protective caps are secured between the disks the hammer axes. The rotor, by way of the protective caps having elements formed as segments of a circular arc, forms a substantially cylindrical jacket with openings which are mutually offset in a predetermined manner, allowing the hammers to swing through. The outer protective caps are decoupled from the forces produced by the hammers and the hammer axes. A locking dog which is attached directly to the end disks, limits and secures the axial position of the respective hammer axis on the end disk. The outer protective caps can be attached to the disks in a simple manner, which saves material and costs.

Unlike in the present state of the technology as disclosed in U.S. Pat. No. 4,222,530 the protective caps of the present invention covering the outer disks of the rotor are decoupled from the forces produced by the hammer axes and from the forces exerted by the hammers directly on the outer protective caps. This is accomplished by having the outer protective caps, which are exposed to the lateral forces of the hammers, simultaneously encompass with their respective web the outer edge of the disks, and with a projection formed as a circular segment a shoulder of the disk. The outer protective caps are formfittingly attached to the disk by at least one connecting element, such as a hexagon socket screw. On the other hand, the outer protective caps abutting the inner protective caps are secured to the outer disk in force-transmitting arrangement by at least one connecting element, such as a hexagon socket screw. A locking dog which is also attached directly to the disk, secures and limits the axial position of the respective hammer axis on the disk.

With this arrangement according to the object of the invention, the outer protective caps which are subjected to the lateral forces of the hammers, are no longer exposed to the additional forces of the hammer axes experienced with prior arrangements and are therefore securely and formfittingly connected. The hammer axes are secured only by the locking dogs. The outer protective caps abutting the inner protective caps, where only a minimal force is transmitted from the inner protective cap to the outer protective cap, have an adequate force-transmitting connection.

Surprisingly, it has been observed that the improved force decoupling according to the invention has not only constructive and technological advantages for the manufacturer, but has also technological advantages for the operator, and eliminates breakage altogether.

As a further advantage, costs associated with maintaining a parts inventory can be reduced by storing the replacement parts according to the invention and also due to the improved maintenance intervals.

These advantageous effects support additional features of the invention, in that the outer surface of the disk can be made substantially planar by providing the webs of the outer protective caps with recesses which at least partially encompass the locking dogs. In a further improvement, the webs and the locking dogs have in their respective contours similar recesses located on the outside of the disk, thereby eliminating any projecting parts. This is achieved by attaching to a planar disk another disk with peripheral contours which essentially follow the tangential contours of the webs and the locking dogs, wherein these contours have openings facing the disk, with the locking dogs and the webs inserted in the openings to form a substantially planar surface.

It is advantageous for rotors subjected to excessive wear, if the respective web of the edge protection caps which are subjected to the lateral forces of the hammers, is formfittingly attached to the end disk through at least one attachment element, such as a hexagon socket screw, with the head of the screw resting on the threaded bore in the end disk, wherein a play exists between the head and the flange-like shoulder of the head and the respective stepped bore in the web.

Conversely, the webs of the protective caps, which abut the inner protective caps, are secured for force transmission using the attachment elements, such as hexagon socket screws, by having the flange-like shoulder of the head rest on the respective stepped bore in the web.

To protect the inner sides of the attachment elements, such as the hexagon socket screws, from becoming deformed by the wear process, connecting elements, preferably cap nuts, are inserted from the inner side and are secured either formfittingly or for force transmission, with the surface of the cap nut being flush with the inner surface of the disk.

The combined design and functionality of the characteristic features of the invention provides a rotor of a significantly improved design and other technical advantages, both in manufacturing and applications.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

The drawings show in

DETAILED DESCRIPTION OF THE PRESENTLY PREFERRED EMBODIMENTS

Figure 1:
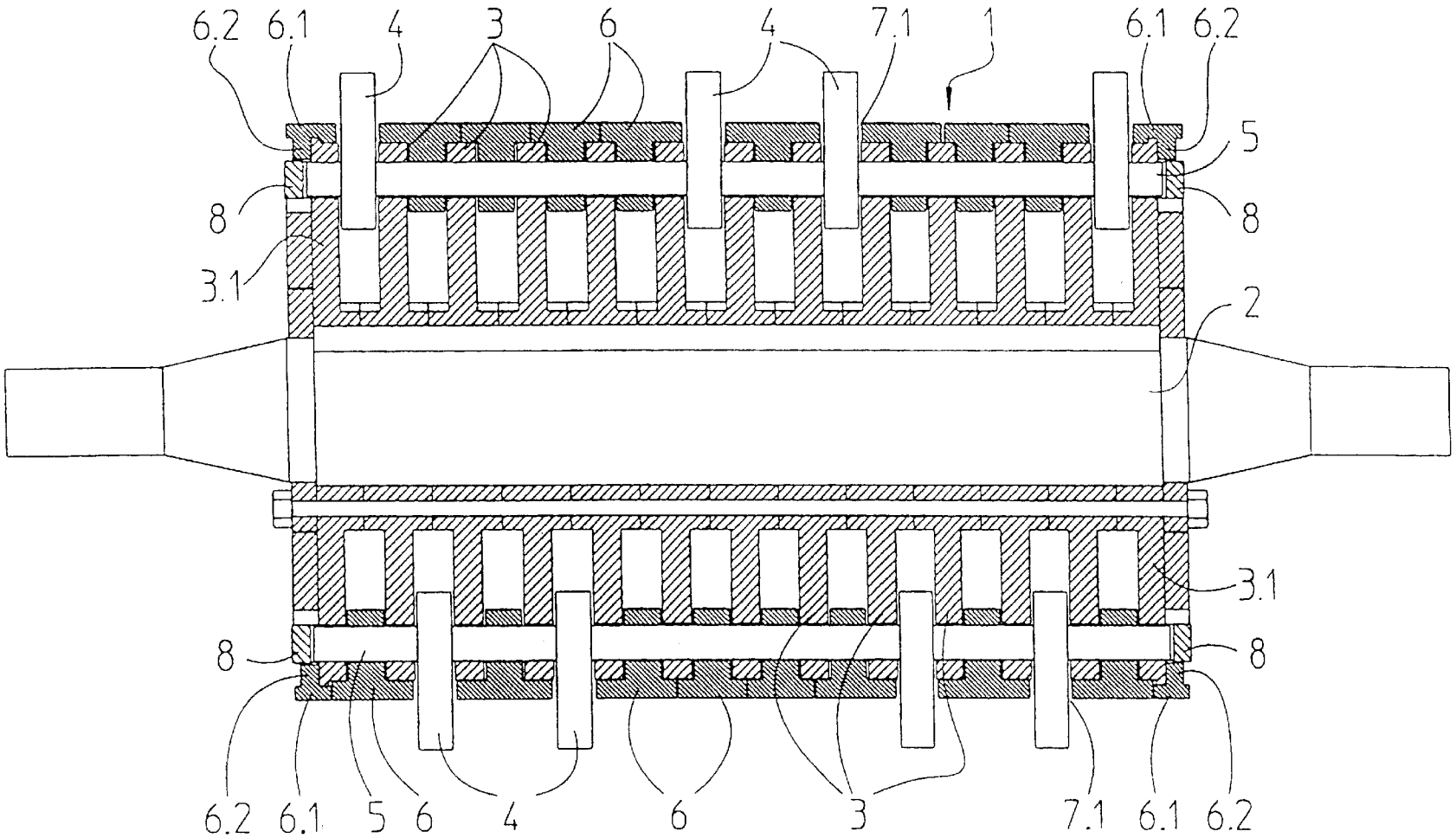
FIG. 1 a cross-sectional view of the rotor along the line 1—1 of FIG. 2, FIG. 2 a side view of the rotor of FIG. 1, FIG. 3 an outer protective cap with a projection in the form of a ring segment in side view, FIG. 3*a* an outer protective cap with a projection in the form of a ring segment with a partial section showing a formfitting attachment, FIG. 4 an outer protective cap without a projection in the form of a ring segment in side view, FIG. 4*a* an outer protective cap without a projection in the form of a ring segment with a partial section showing an attachment for force transmission, FIG. 5 a partial section of an attachment with cap nuts inserted in the disk 3.1.

FIGS. 1 and 2 depict a rotor 1 for a hammer mill, which essentially consists of several disks 3 which are non-rotatably secured to a shaft 2, and hammers 4 distributed between the disks 3. The hammers 4 are rotatably supported on hammer axes 5 which extended through the disks 3 and are oriented parallel to the shaft 2. At least the parts of the rotor which are subjected to secondary wear, are covered with the elements 6.4 of the protective caps 6, with the elements 6.4 being formed as circular arc segments. The elements 6.4 form an essentially cylindrical jacket 7 with openings 7.1 which are mutually offset from one another and arranged in a predetermined pattern, and through which openings the hammers 4 can swing. As shown in FIGS. 2 and 3, the edge protection caps 6.1 covering the end disks 3.1 of the rotor 1 are decoupled from the forces produced by the hammers 4 and the hammer axes 5 as well as from the forces applied by the hammers 4 directly to the edge protection caps 6.1. The edge protection caps 6.1 are attached directly to the end disks 3.1 through webs which encompass the outward-facing portion of the outer edge of the end disks 3.1. The respective web 6.2 has a recess 6.3 (FIGS. 2, 3 and 4) which is partially encompassed by a locking dog 8 which is also attached directly to the end disk 3.1 (FIG. 2) and limits and secures the axial position of the respective hammer axes 5 on the end disk 3.1.

As seen in FIGS. 3, 3*a*, the edge protection cap 6.1 which is subjected to the lateral forces produced by the hammers 4, is formfittingly connected through a projection 6.5 which is formed as a ring segment and engages with a shoulder 3.2 of the end disk 3.1, and through at least one hexagon socket screw forming a connecting element 10, with the head of the screw resting on the threaded bore in the end disk 3.1. Furthermore, play is provided between the head and its flange-like shoulder and the correspondingly stepped bore in the web 6.2.

Conversely, as shown in FIGS. 4, 4*a* the web 6.2 of the edge protection cap 6.1 which abuts the respective inner protective cap 6, is secured for force transmission on the end disk 3.1 through at least one hexagon socket screw forming the analogous connecting element 10. In this case, the flange-like shoulder of the screw head rests in the respective stepped bore in the web 6.2.

To prevent the hexagon socket screws which forms the connecting element 10 from becoming dangerously deformed, the screws, as depicted in FIG. 5, engage with attachment elements 9 formed as cap nuts, which are inserted from the other side of the end disk 3.1 and are secured either formfittingly or for force transmission.

According to a technologically advantageous embodiment depicted in FIGS. 1 and 2, a cover disk 3.3 which follows the contours of the web 6.2 and the locking dogs 8 indicated in FIG. 2, is connected with the disk 3.1. The locking dogs 8 are inserted in the recesses formed in the end disk 3.1 so as to form an essentially planar surface without elements projecting therefrom.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A rotor (1) for a comminution machine with a plurality of disks (3) non-rotatably attached to a shaft (2), and hammers (4) distributed between the disks (3), with the hammers rotatably supported on hammer axes (5) extending through the disks (3) and which are parallel to and eccentric with respect to the shaft (2), having protective caps (6) which cover at least components of the rotor (1) exposed to secondary wear and have elements (6.4) shaped as a segment of a circular arc, with bearing hubs of the protective caps secured on the hammer axes (5) between the disks (3), wherein the rotor (1), by way of the protective caps (6) having the elements (6.4) formed as segments of a circular arc, forms a substantially cylindrical jacket (7) with openings offset with respect to each other in a predetermined fashion for allowing the hammers (4) to swing through, wherein edge protection caps (6.1) are decoupled from the forces of the hammers (4) and the hammer axes (5), wherein a locking dog (8) which is attached directly to end disks (3.1) secures an actual position of the respective hammer axis (5) in the end disk (3.1), wherein a) the edge protection caps (6.1) covering the end disks (3.1) of the rotor are decoupled from the forces exerted by the hammers (4) directly on the edge protection caps (6.1);

b) the edge protection caps (6.1) which are subjected to the lateral forces produced by the hammers (4), encompass the outer edge of the end disks (3.1) with webs (6.2) and also an inner shoulder (3.2) of the end disk (3.1) with projections (6.5) formed as a circular arc segment, and the edge protection caps (6.1) are formfittingly secured with at least one connecting element (10) on the end disk (3.1);

c) whereas the edge protection caps (6.1) abutting the inner protective caps (6) are secured for force transmission to the end disk (3.1) through the respective connecting element (10).

2. The rotor according to claim 1, wherein each of the respective webs (6.2) has a recess (6.3) which encompasses at least a portion of the locking dog (8).

3. The rotor according to claim 2, wherein the webs (6.2) and the locking dogs (8) have contours similar to the recesses formed on the outside of a cover disk (3.3) and the cover disk is connected with the end disk (3.1) and has peripheral contours which essentially follow the tangential contours of the webs (6.2) and the locking dogs (8), thereby forming a planar surface without projecting portions, wherein these contours facing the end disk (3.1) form the recesses in which the locking dogs (8) and the webs (6.2) are inserted.

4. The rotor according to claim 3, wherein each respective web (6.2) of the edge protection caps (6.1) which are subjected to the lateral forces of the hammers (4) is formfittingly attached to the end disk (3.1) with at least one connecting element (10), in form of a hexagon socket screw, with a head of the screw resting on a threaded bore in the end disk (3.1), wherein a play is provided between the head and a flange-like shoulder of the head and the respective recess in the web (6.2).

5. The rotor according to claim 4, wherein each of the respective web (6.2) of the edge protection caps (6.1) abutting the inner protective caps (6) is attached for force transmission with the at least one connecting element (10), in form of a hexagon socket screw, with the flange-like shoulder of the screw head resting on the respective recess in the web (6.2).

6. The rotor according to claim 5, wherein the end disk (3.1) has attachment elements (9) inserted on its inner surface, with the attachment elements protecting the connecting elements (10) engaging therewith from deformation.

7. The rotor according to claim 6, wherein the attachment element (9) is a cap nut which is inserted into the end disk (3.1), wherein a surface of the cap nut forms a plane with the inner surface of the end disk (3.1).

8. The rotor according to claim 6, wherein the attachment element (9) is formfittingly secured.

9. The rotor according to claim 6, wherein the attachment element (9) is secured for force transmission.

* * * * *